US008196791B2

(12) United States Patent
Hogg

(10) Patent No.: US 8,196,791 B2
(45) Date of Patent: Jun. 12, 2012

(54) CYLINDER LOADING AND RETAINING DEVICE FOR A HARNESS

(75) Inventor: Simon Christopher Hogg, Tyne & Wear (GB)

(73) Assignee: Draeger Safety UK Limited, Blyth, Northumberland (GB)

( * ) Notice: Subject to any disclaimer, the term of this patent is extended or adjusted under 35 U.S.C. 154(b) by 659 days.

(21) Appl. No.: 11/972,082

(22) Filed: Jan. 10, 2008

(65) Prior Publication Data

US 2008/0179365 A1 Jul. 31, 2008

(30) Foreign Application Priority Data

Jan. 31, 2007 (GB) ..... 0701865.8

(51) Int. Cl.
*A45F 3/04* (2006.01)
*A44B 11/00* (2006.01)

(52) U.S. Cl. ..... 224/634; 224/628; 224/633; 224/934; 248/313

(58) Field of Classification Search ..... 224/483, 224/600, 628, 633, 634, 637, 934; 24/483; 128/205.22; 248/313; 405/185–187
See application file for complete search history.

(56) References Cited

U.S. PATENT DOCUMENTS

| | | | | |
|---|---|---|---|---|
| 2,764,151 | A * | 9/1956 | Cupp | 128/202.22 |
| 3,490,727 | A * | 1/1970 | Miller | 248/284.1 |
| 4,327,851 | A * | 5/1982 | Feathers | 224/634 |
| 5,522,679 | A | 6/1996 | Eungard | |
| 5,906,302 | A * | 5/1999 | Spergel | 224/250 |
| 6,582,157 | B1 * | 6/2003 | Takeuchi et al. | 405/186 |
| 6,920,879 | B2 * | 7/2005 | Haeuser | 128/205.22 |
| 7,448,586 | B2 * | 11/2008 | Ziaylek et al. | 248/311.3 |
| 2008/0128464 | A1 * | 6/2008 | Gale et al. | 224/570 |

FOREIGN PATENT DOCUMENTS

| | | |
|---|---|---|
| DE | 44 36 726 A1 | 4/1995 |
| EP | 1 516 811 A2 | 3/2005 |

OTHER PUBLICATIONS

Partial European Search Report for application No. 07124125.1-1258 dated Jun. 16, 2008.

* cited by examiner

*Primary Examiner* — Justin Larson
*Assistant Examiner* — Adam Waggenspack
(74) *Attorney, Agent, or Firm* — DLA Piper LLP (US)

(57) ABSTRACT

A cylinder back plate includes a frame member 11 and a cylinder clamp 12 connected to the frame member 11 by means of a pivot 13. The cylinder clamp 12 comprises a band of rigid or semi-rigid material. The cylinder clamp 12 has a retaining position with respect to the frame member 11, wherein the cylinder clamp extends substantially perpendicularly to the plane of the frame member. The frame member 11 lies parallel to a back plate of the harness or is constituted by the back plate of the harness. Thus, when the cylinder clamp 12 is in the retaining position a cylinder can be retained securely to the frame member and sliding of the cylinder relative to the frame member or back plate can be prevented. When it is desired to attach a new cylinder to the harness, the cylinder clamp 12 can be pivoted into a loading position.

11 Claims, 3 Drawing Sheets

CYLINDER LOADING AND RETAINING DEVICE FOR A HARNESS

BACKGROUND OF THE INVENTION

The invention relates to a cylinder loading and retaining device for a harness and also to a harness including such a device. In particular, the invention relates to a cylinder loading and retaining device for mounting a cylinder of breathable gas to a harness for a breathing apparatus of the type used by fire fighters. The invention could also be applied to other types of harness, such as a diving harness.

A known harness 1 for carrying a cylinder 3 of breathable gas is shown in FIG. 1. The harness includes a back plate 2 onto which an air or gas cylinder 3 is mounted. At its lower end, the cylinder 3 is attached to a valve 4 and is retained to the back plate 2. Air is supplied from the cylinder 3 to the wearer through the valve 4 and air lines 5, 6 one of which extends to a breathing apparatus and the other of which extends to a pressure gauge (neither shown). A fabric strap 7 is provided towards the upper end of the cylinder 3 for securing the cylinder 3 to the back plate 2 and for preventing the cylinder 3 from sliding downwards.

The cylinder 3 is usually mounted onto the harness 1 in a service workshop. Alternatively, the cylinder 3 may be mounted to the harness whilst the harness is being worn by a firefighter. In order to mount the cylinder 3 to the harness, the cylinder 3 must be aligned with the back plate 2 for insertion through the fabric strap 7. This is awkward and time consuming, particularly as the fabric strap 7 has a tendency to flop downwards. Furthermore, if the cylinder 3 is mounted whilst the harness is being worn, the cylinder 3 must be inserted substantially vertically upwards, which is difficult to do.

A known alternative to the fabric strap 7 is a metallic strap. This has the advantage of having greater rigidity, and thus does not tend to flop downwards. Nevertheless, in mounting a cylinder 3 to a harness having a metallic strap it is still necessary to ensure that the cylinder 3 is aligned with the back plate 2 of the harness. This can be awkward, especially if the cylinder 3 is changed whilst the harness is being worn.

Clearly, it is desirable to enable the cylinder 3 to be mountable to the harness as quickly and easily as possible, for example to facilitate a swift change-over of a used or damaged cylinder 3 to a new cylinder 3. This is especially desirable as the harness is usually being worn by a firefighter at an incident.

SUMMARY OF THE INVENTION

According to a first aspect of the invention, there is provided a cylinder retaining device for a harness, comprising: a frame member; and a retaining member connected to the frame member for receiving a portion of a cylinder, wherein the retaining member is movable with respect to the frame member between a loading position, in which the cylinder can be at least partly inserted into, or withdrawn from, the retaining member, and a retaining position, in which the cylinder is retained by the retaining member.

Advantageously, because the retaining member is movable with respect to the frame member between the loading position and the retaining position, the cylinder can be inserted into the retaining member, and thus mounted to a harness, without having to align the cylinder with the frame member (and hence with a back plate of the harness).

Preferably the retaining member is pivotally connected to the frame member and can pivot between the loading position and the retaining position. In this way, the retaining member can move smoothly and easily between the two positions, facilitating mounting of the cylinder.

In addition, the device may further comprise a locking mechanism for maintaining the retaining member in the retaining position. In this way, the retaining member can be maintained securely in the retaining position until the cylinder has been inserted into it. The locking mechanism may include, for example, a biasing means, a latch, a catch or a stop.

It is preferable that in the loading position the cylinder may be at least partly inserted into the retaining member at an obtuse angle with respect to the frame member, and in the retaining position the cylinder is retained substantially parallel to the frame member.

The retaining member may be a cylinder clamp comprising a band or ring of rigid or semi-rigid material, such as a metallic or hardened-fabric material. In addition, the cylinder clamp may include a length adjusting means for varying the length of the cylinder clamp so as to allow different sizes of cylinders to be accommodated and retained securely.

According to a second aspect of the invention, there is provided a harness for use with breathing apparatus, the harness including a cylinder loading and retaining device of the type described herein.

According to a third aspect of the invention, there is provided an assembly comprising a harness according to the present invention and a cylinder of breathable gas mounted to the harness.

In a fourth aspect, the invention provides a method of modifying a harness for use with breathing apparatus, the method comprising the step of attaching a device of the type described herein to the harness.

The invention may comprise any combination of features or limitations described herein, except of such features as are mutually exclusive.

BRIEF DESCRIPTION OF THE DRAWING

Reference is now made, by way of example only, to the accompanying drawings, in which.

DESCRIPTION OF AN EMBODIMENT OF THE INVENTION

Figure 2:
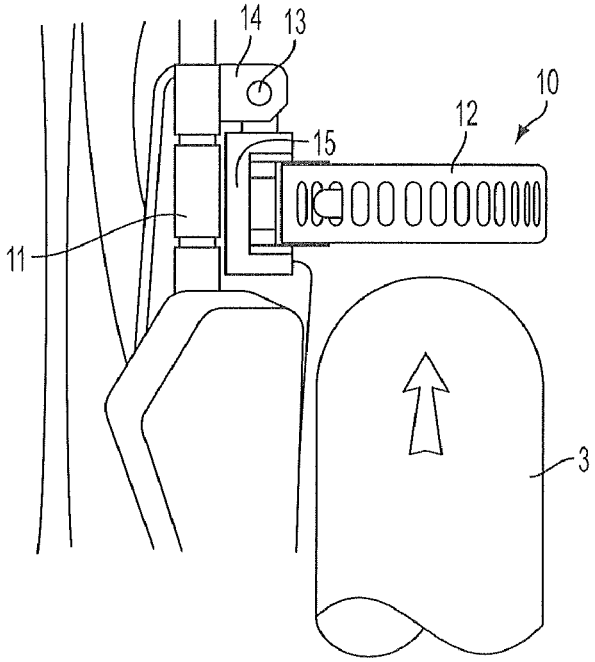
FIG. 2 is a side view of a cylinder loading and retaining device according to an embodiment of the invention, wherein a cylinder clamp is in a retaining position.

FIG. 2 is a side view of a cylinder loading and retaining device 10. The device 10 comprises a frame member comprising a first frame member 11, a projecting piece 14, and a second frame member 15 suspended from the first frame member by means of a pivot 13; and a cylinder clamp 12 connected to the second frame member 15. The cylinder clamp 12 comprises a band of rigid or semi-rigid material. In FIG. 2, the cylinder clamp 12 is shown in a retaining position with respect to the first frame member 11, wherein the cylinder clamp extends substantially perpendicularly to the plane of the first frame member 11.

Figure 1:
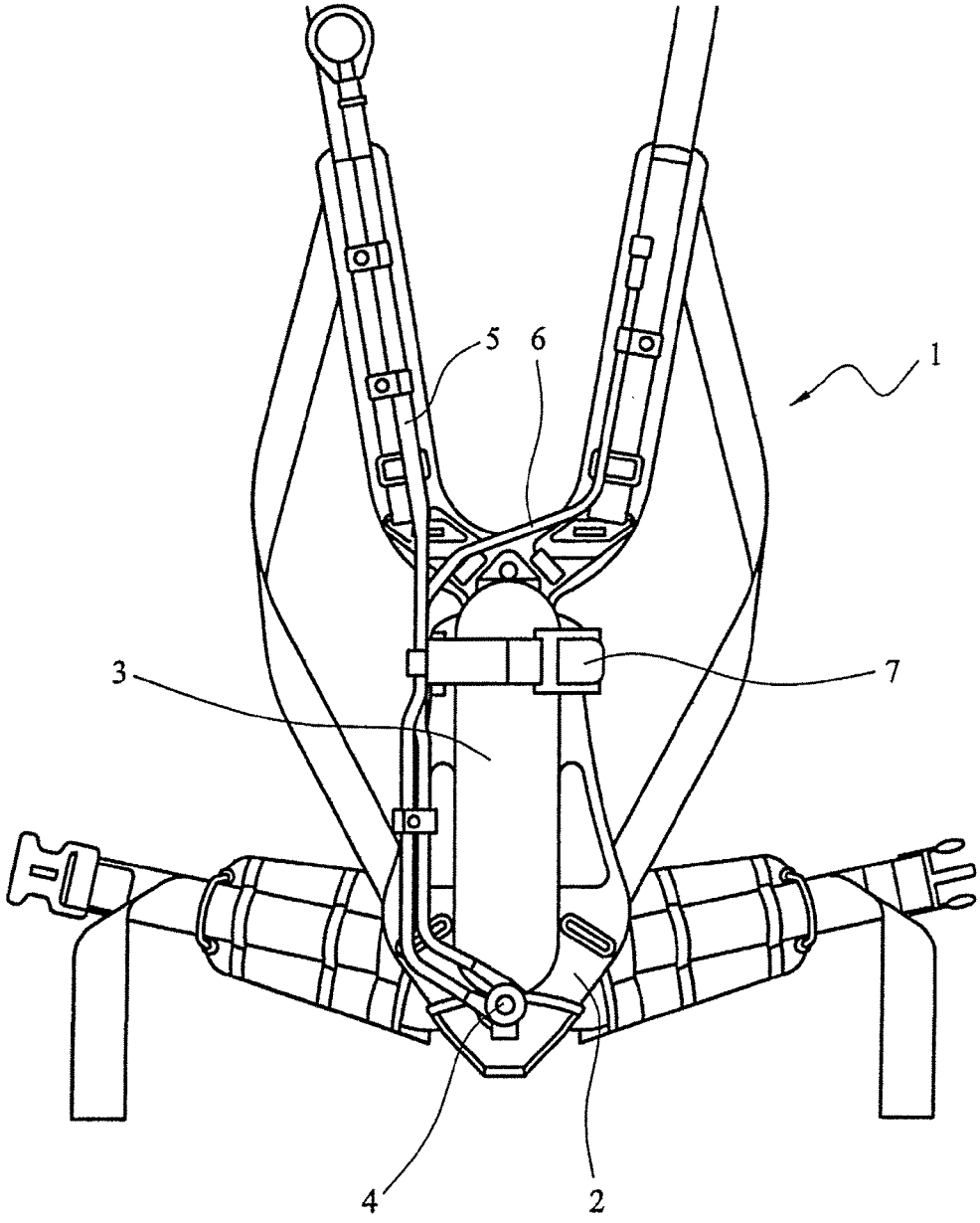
FIG. 1 shows a harness having a known cylinder retaining strap.

When the device is applied to or incorporated with a harness, the first frame member 11 lies parallel to a back plate of the harness or is constituted by (e.g. integral with) the back plate (2 in FIG. 1) of the harness. Thus, when the cylinder clamp 12 is in the retaining position a cylinder 3 can be retained securely to the first frame member 11 and sliding of the cylinder 3 relative to the first frame member 11 (hence, back plate 2) can be prevented.

Figure 3:
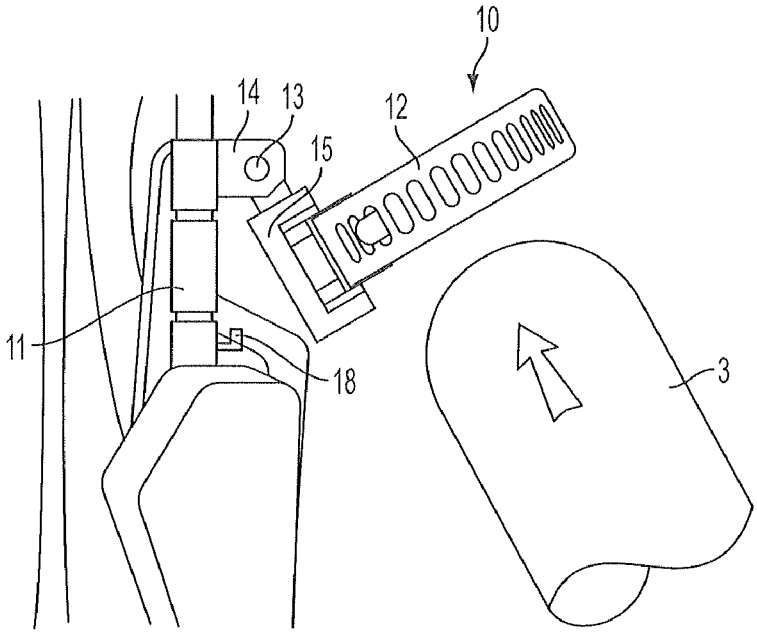
FIG. 3 is a side view of the device of FIG. 2, wherein the retaining member is in a loading position.

Furthermore, when it is desired to attach a new cylinder 3 to the harness, the cylinder clamp 12 can be pivoted into a loading position as shown in FIG. 3. The loading position is not necessarily fixed but may be varied to an appropriate loading angle. In the loading position, the cylinder clamp 12 is angled obtusely with respect to the first frame member 11, and hence with respect to the back plate 2 of the harness also. Thus, when the cylinder clamp 12 is in the loading position, an angled cylinder mounting direction is presented for inserting the cylinder 3 into the clamp 12. In this way, it is unnecessary to align the cylinder 3 with the back plate 2 of the harness and instead the cylinder 3 can be fed more naturally and easily into the cylinder clamp 12.

Figure 4:
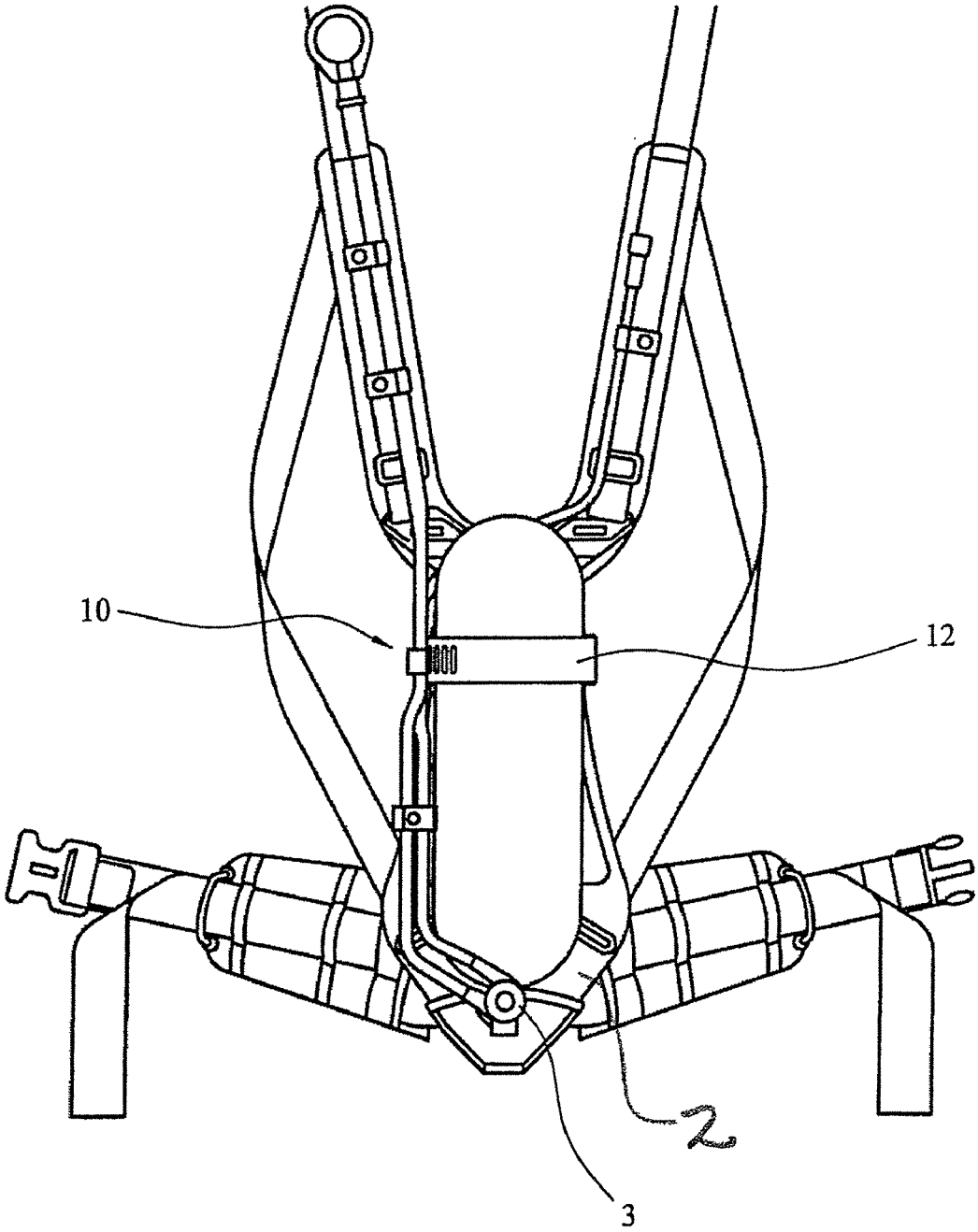
FIG. 4 is a rear view of a harness including a cylinder loading and retaining device embodying the invention and having an air cylinder mounted thereto.

After the foremost or top part of the cylinder 3 has entered the clamp 12, the clamp 12 can be pivoted into the retaining position to retain the cylinder 3 against the first frame member 11. Thus, in a harness, the cylinder 3 is held securely against the back plate 2 of the harness as shown in FIG. 4. The frictional force of the cylinder clamp 12 against the outer surface of the cylinder 3 prevents the cylinder from slipping. As with the harness of FIG. 1, a lower end of the cylinder 3, furthest from the clamp 12, is connected to a valve 4 and is retained against the back plate 2 of the harness.

In a further embodiment of the device, a locking mechanism 18 in FIG. 3 is provided to maintain the clamp 12 in the retaining position. The locking mechanism 18 may include a latch, a catch or a stop. Alternatively, a biasing means may be provided, for example, incorporated in the pivot 13.

In another embodiment, the cylinder clamp 12 includes a length adjusting means for enabling the length of the band of the clamp 12 to be varied, so as to enable different sizes of cylinder to be retained securely by the clamp 12. For example, if the clamp 12 comprises a hardened fabric, such as a rubber coated fabric, the length adjusting means may comprise a buckle arrangement. If the clamp 12 is metallic, a hook and pin arrangement may be used. The pivot 13 may be provided by any suitable means, such as a roller (e.g. pin or rod) and bushing arrangement with or without an integral biasing element.

While embodiments of the invention have been disclosed, the invention is to be limited only by the following claims and equivalents thereof.

What is claimed is:

1. A harness for use with a breathing apparatus, comprising:

a frame member which is combined with the back plate of the harness, the frame member comprising a first frame member, a projecting piece, and a second frame member; a pivot located at the top of the second frame member such that the second frame member is pivotably suspended from the pivot on the projecting piece; a retaining member comprising a band attached on the second frame member for receiving a portion of a cylinder, such that the retaining member can pivot about a pivot axis which is transversely extending with respect to the first frame member between a loading position in which the retaining member is angled obtusely with respect to the first frame member so that the cylinder can be at least partly inserted into or withdrawn from the retaining member, and a retaining position in which the retaining member is approximately at a right-angle to the first frame member so as to retain the cylinder; and a valve attached to the harness and arranged to be attached to a lower end of the cylinder.

2. A device according to claim 1, further comprising a locking mechanism for maintaining the retaining member in the retaining position.

3. A device according to claim 1, wherein the locking mechanism consists of an element selected from a biasing element, a latch, a catch and a stop.

4. A device according to claim 1, wherein in the loading position the cylinder may be at least partly inserted into the retaining member at an obtuse angle with respect to the frame member, and in the retaining position the cylinder is retained substantially parallel to the frame member.

5. A device according to claim 1, wherein the retaining member is a cylinder clamp comprising a band or ring of rigid or semi-rigid material.

6. A device according to claim 5, wherein the cylinder clamp comprises a metallic or hardened-fabric material.

7. A device according to claim 5, wherein the cylinder clamp includes a length adjusting means for varying the length of the cylinder clamp.

8. A retaining device as set forth in claim 1 in combination with a cylinder having a top end'retained by the retaining device and a bottom end retained against the back plate of the harness.

9. A cylinder mounting assembly comprising, in combination:

a back plate assembly having an upper end and a lower end;

a body attachment harness attached to the back plate assembly;

a cylinder mounted on the back plate assembly by mounting elements, said mounting elements including a valve assembly at the lower end of the back plate assembly and a cylinder retaining clamp at the upper end, said cylinder retaining clamp including a frame member attached to the back plate assembly and a band attached on the frame member, the frame member comprising a first frame member, a projecting piece, a second frame member, and a pivot located at the top of the second frame member such that the second frame member is pivotably suspended from the pivot on the projecting piece, and the band formed to fit around the cylinder and movable between a first retention position in which the band is angled obtusely with respect to the second frame member so that the cylinder can be at least partly inserted into or withdrawn from the band, and a second cylinder release position in which the band is approximately at a right-angle to the first frame member.

10. The assembly of claim 1 further including a locking mechanism for retaining the band in the first position.

11. A breathing apparatus comprising:

a harness comprising:

a back plate;

a cylinder valve;

a frame member at the top of the back plate comprising a first frame member, a projecting piece, and a second frame member; a pivot located at the top of the second frame member such that the second frame member is pivotably suspended from the pivot on the projecting piece; a retaining member comprising a band attached on the second frame member;

a retaining member comprising a band connected to the suspended end of the second frame member, such that the retaining member can pivot about a pivot axis which is transversely extending with respect to the back plate between a loading position in which the retaining member is angled obtusely with respect to the back plate and a retaining position in which the retaining member is approximately at a right-angle to the back plate; and a cylinder of breathable gas mounted to and retained on the back plate, wherein an end of the cylinder is connected to the valve and a portion of the cylinder is disposed within the band with the retaining member in the retaining position, thereby retaining the cylinder on the back plate.

* * * * *